US005548878A

United States Patent [19]

Romagnoli

[11] Patent Number: 5,548,878

[45] Date of Patent: Aug. 27, 1996

[54] LOAD SPREADING BELT WITH BUCKLE CLOSURE

[76] Inventor: Joseph D. Romagnoli, 1014 Conley Cir., Ocean Springs, Miss. 39564

[21] Appl. No.: 357,915

[22] Filed: Dec. 16, 1994

[51] Int. Cl.[6] ..... A44B 11/00

[52] U.S. Cl. ..... 24/306; 24/168; 24/442; 24/633

[58] Field of Search ..... 24/306, 442, 168, 24/169, 303, 365 WS, 573.1, 633, 634

[56] References Cited

U.S. PATENT DOCUMENTS

| | | | |
|---|---|---|---|
| 1,266,680 | 5/1918 | Hall | 24/168 |
| 2,586,758 | 2/1952 | Berr | 24/168 |
| 3,866,276 | 2/1975 | Perkins | 24/306 |
| 4,038,726 | 8/1977 | Takabayashi | 24/169 |
| 4,065,834 | 1/1978 | Montague, Jr. | 24/442 |
| 4,918,790 | 4/1990 | Cirket et al. | 24/442 |
| 4,941,236 | 7/1990 | Sherman et al. | 24/303 |
| 5,086,758 | 2/1992 | Schiek, Sr. et al. | 602/19 |
| 5,129,129 | 7/1992 | Collins et al. | 24/633 |
| 5,167,050 | 12/1992 | Korsen | 24/16 R |
| 5,176,106 | 1/1993 | Casto et al. | 119/865 |
| 5,187,843 | 2/1993 | Lynch | 24/576 |
| 5,189,767 | 3/1993 | Reitsma | 24/633 |
| 5,191,685 | 3/1993 | Aoki et al. | 24/656 |
| 5,243,740 | 9/1993 | Wakabayashi | 24/170 |
| 5,243,741 | 9/1993 | Fudaki et al. | 24/200 |
| 5,263,234 | 11/1993 | Fudaki | 24/662 |
| 5,267,377 | 12/1993 | Gills et al. | 24/641 |

*Primary Examiner*—Victor N. Sakran
*Attorney, Agent, or Firm*—Sand & Sebolt

[57] ABSTRACT

A load spreading belt includes a buckle closure and an elongated flexible strap having a pair of ends. A pad of locking catches is mounted on one end of the strap and a pad of catch receivers is mounted on another end of the strap. When the strap encircles a load to be retained in position, the ends of the strap overlap such that the locking catches and catch receivers are in mating engagement. The buckle includes a top and a base. A rear plate and a pair of posts spaced from the rear plate, extend between the top and the base and define a passage therebetween. One end of the strap extends through the passage with the locking catches extending outwardly on either side of each post to removably retain the buckle on the strap. In one embodiment a door is hingedly attached to the base of the buckle and closes around the strap ends when the locking catches and catch receivers are in mating engagement. In another embodiment the top and base of the buckle include recesses, and a door is frictionally engaged and retained in the recesses when positioned over the strap. The buckle provides constant clamping force in a direction transverse to the longitudinal direction of the strap thus securing the strap ends in overlapping position without a concentration of forces at a single point or line contact.

18 Claims, 3 Drawing Sheets

LOAD SPREADING BELT WITH BUCKLE CLOSURE

BACKGROUND OF THE INVENTION

1. Technical Field

The invention relates generally to retaining belts. More particularly, the invention relates to retaining belts which include a flexible or elastic strap and a buckle for securing the free ends of the strap in an overlapping position. Specifically, the invention relates to a belt in which the strap and buckle operatively engage one another to evenly distribute forces acting on the belt across a large surface area.

2. Background Information

Since the early ages of man, belts have included a flexible strap and a buckle of some type for retaining the ends of the strap in an overlapping position and have been used in a variety of situations. The use for belts of this type are quite varied and range from securing loads to trucks and trailers to securing a pair of pants to a user.

Great effort has been made over the years to make the appearance of these belts more pleasing and to strengthening these belts without compromising flexibility or aesthetics. While existing belts may take a variety of sizes and configurations, as a general rule, these belts include a flexible strap having a plurality of holes at one end, and a buckle attached to the other end which includes a catch for extending through one of the holes in the flexible strap. The strap is passed through the buckle, and the catch is moved into engagement with one or more of the holes. In this manner, the belt ends are effectively latched against movement relative to each other. While this type of belt is presumably adequate for the purpose for which it is intended, its operation and design include a number of drawbacks.

Specifically, existing belts require the user to exercise significant finger dexterity when moving the catch into an associated hole. This can be difficult for children, elderly persons, and persons suffering from arthritis or poor eye sight. Yet another problem associated with existing belts is that they are not capable of continuous adjustment as the catch is placed in discretely positioned holes along the belt's length. The lack of continuous adjustment along the belt's length often prevents the belt from effectively securing the load. When the catch is positioned in one hole the belt may be too loose, and when positioned in an adjacent hole, the belt may be too tight.

Moreover, the force holding the belt in the latched position is generally concentrated at a point or at best, along a line. Specifically, the strap is generally folded back upon itself encircling a portion of the buckle such that when force acts against the buckle it acts along the line between the strap and buckle. When the buckle is in the latched position such that the catch extends through an associated hole in the strap, forces in the strap are concentrated at the point of contact between the catch and the strap surrounding the hole through which the catch is placed. This point load may be reduced by increasing the number of catches extending through the strap, with the result being merely that the load has been transmitted to a number of points along the width of the strap rather than a single point.

Inasmuch as forces acting on the strap act at a single point, or at best along a line, the strap in these specific areas degrades faster than the remaining portion of the strap significantly increasing replacement costs. As a result, the strap, and specifically that portion of the strap adjacent the buckle, is manufactured of thicker, more durable materials.

The use of such materials substantially increase the cost of manufacturing belts of this type. Moreover, if the belt is to be used in a restricted area, the thicker, more durable material is more burdensome to accommodate and more difficult to use. Similarly, thicker, more durable strapping material is less flexible, and as a result, is more difficult to use.

While thicker, more durable materials partially solve the above referenced problems associated with holding forces on straps adjacent buckles, large loads acting in these areas continue to reduce the life span of existing belts. Moreover, as the strap degrades adjacent the buckle, the strength of the belt may be compromised creating an unsafe condition, especially when the belt is utilized to hold mobile loads in position. Still further, deformed strapping material adjacent the belt may be unsightly, especially when used as wearing apparel. Similarly, thicker more durable material, while reducing the possibility of strapping material deformation, may be considered equally unsightly.

Therefore, the need exists for a belt which can easily be manipulated by persons having reduced dexterity, and which substantially eliminates strapping material degradation adjacent the buckle by evenly distributing holding forces over a large surface to reduce belt wear and prevent belt damage.

SUMMARY OF THE INVENTION

Objectives of the invention include providing a belt which includes a flexible strap and a buckle.

Another objective is to provide a belt which evenly distributes loads over a large surface area to reduce wear on the strap and prevent damage thereto.

A further objective is to provide a belt which eliminates the transmitting of loads from the strap to the buckle at a point or line contact.

Another objective of the invention is to provide such a belt and buckle closure in which the buckle will not fall off the belt when being opened or removed.

Still another objective of the invention is to provide such a belt and buckle closure which reduces the quantity of fastening material required to provide sufficient holding forces and a buckle that improves the efficiency of the fastening mechanism to maintain holding forces which requires less fastener material compared to the material required if no buckle were used.

A still further objective is to provide such a belt which holds securely and can be easily manipulated from the latched to the unlatched position.

Yet another objective is to provide such a belt which is capable of continuous adjustment to accommodate loads having a variety of sizes.

Yet another objective is to provide such a belt which is significantly stronger than existing belts using strapping material of like size and configuration.

A further objective is to provide a belt which is reversible, in which the buckle remains attached to the strap when in the unlatched position, and in which the buckle may be removed easily from the strap.

A still further objective is to provide such a belt which is of simple construction, which achieves the stated objectives in a simple, effective and inexpensive manner, and which solves problems and satisfies needs existing in the art.

These and other objectives and advantages of the invention are obtained by the improved belt, the general nature of which may be stated as including an elongated strap having a pair of ends, a front surface and a rear surface; a locking catch attached to the front surface of the strap adjacent one end of said strap; a catch receiver for receiving the locking catch attached to the rear surface of the strap and adjacent the other end of said strap such that the ends of the strap may be overlapped with said locking catch in mating engagement with said catch receiver in a latching area; a buckle having a body and a door movably mounted on said body for movement between an open and a closed position whereby the body and door define a slot therebetween when the door is in the closed position which slot is sized to accept the strap; and said buckle extending around the ends of the strap substantially encircling at least a portion of the latching area when the door is in the closed position.

BRIEF DESCRIPTION OF THE DRAWINGS

Preferred embodiments of the invention, illustrative of the best mode in which applicant has contemplated applying the principles, are set forth in the following description and are shown in the following drawings and are particularly and distinctly pointed out and set forth in the appended claims.

Similar numerals refer to similar parts throughout the drawings.

DESCRIPTION OF THE PREFERRED EMBODIMENTS

Figure 3:
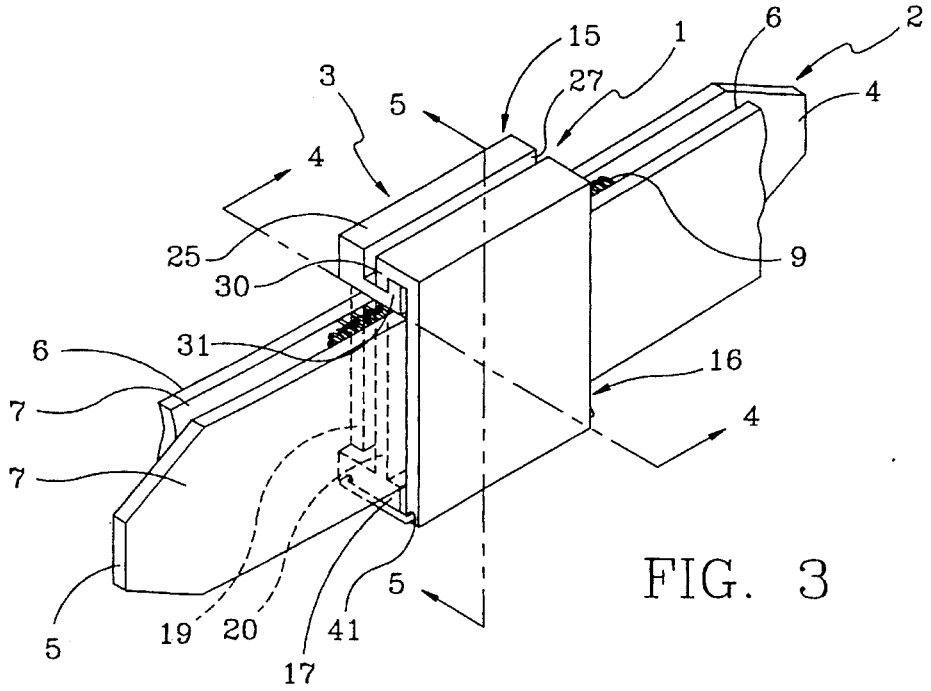
FIG. 3 is a perspective view of the buckle of FIG. 1 in the closed position and shown installed on the ends of the strap of FIG. 1A.

A first embodiment of the improved belt of the present invention is indicated generally at 1, and is shown particularly in FIG. 3, supporting or retaining a load. Belt 1 may be utilized to extend around the user's waste and support a pair of trousers, or around a pallet to retain a load on a vehicle. Belt 1 includes an elongated strap 2, the free ends of which are shown in FIG. 1A, and a buckle 3 shown particularly in FIG. 1.

Elongated strap 2 (FIG. 1A) may be manufactured of a variety of materials, but is preferably manufactured of a pliable, material such as leather or vinyl. Strap 2 includes a pair of ends 4 and 5, a rear surface 6, and a front surface 7. Strap 2 is of sufficient length to assure that ends 4 and 5 overlap when strap 2 encircles an object, such that front surface 7 adjacent end 4 and rear surface 6 adjacent end 5 are in surface contact along a portion of the length of strap 2. While ends 4 and 5 may overlap any convenient amount which is sufficient to spread the load, in the preferred embodiment, ends 4 and 5 overlap in the range of from 2 inches to 6 inches.

Figure 1:
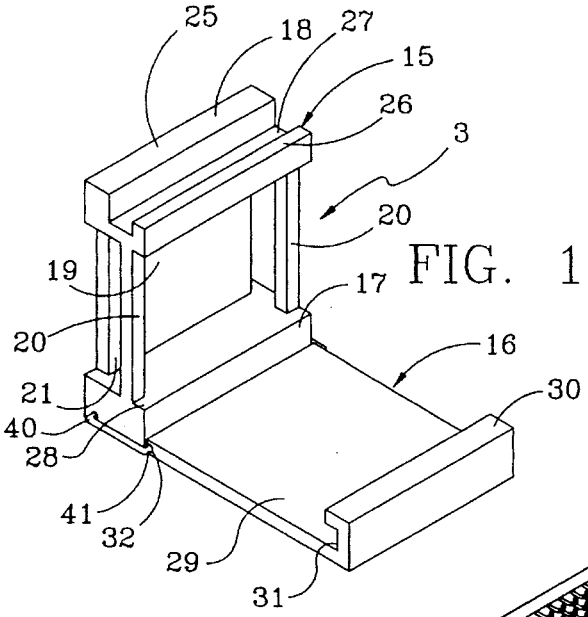
FIG. 1 is a perspective view of a first embodiment of the buckle of the present invention in an open position.
Figure 1B:
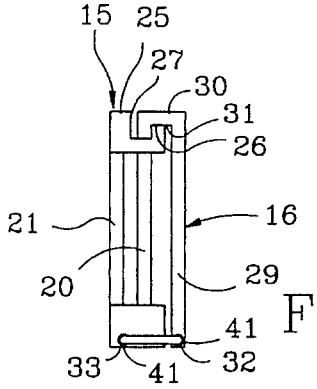
FIG. 1B is a side elevational view of the buckle of FIG. 1 in closed position without the strap ends of FIG. 1A inserted therein.
Figure 1A:
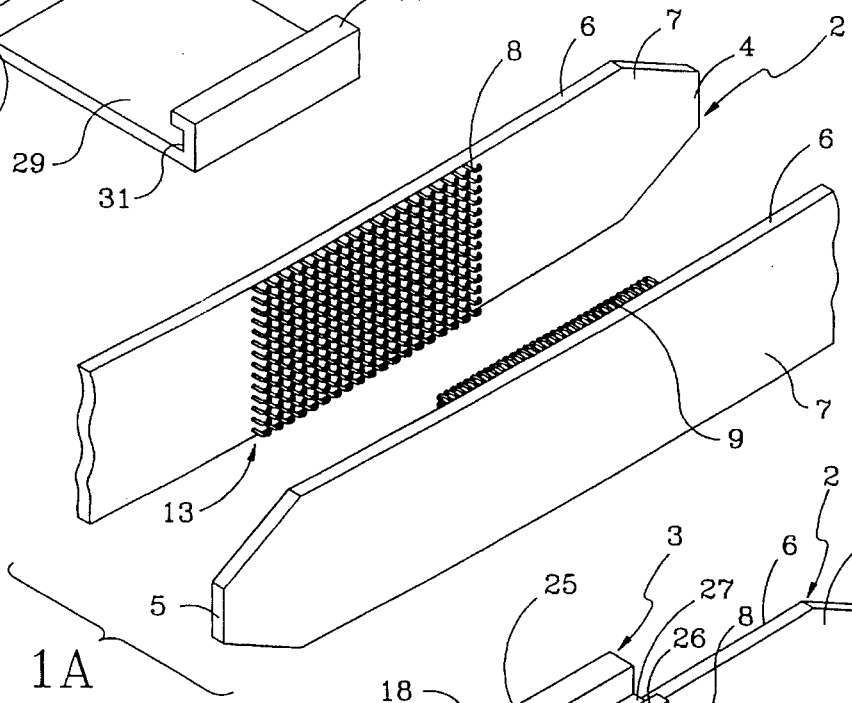
FIG. 1A is a perspective view of the strap of the present invention in the open position for use with the buckle of FIG. 1.

In accordance with one of the features of the present invention, a pad of locking catches 8 is permanently attached to front surface 7 adjacent end 4 (FIG. 1A). Similarly, a pad of catch receivers 9 is permanently attached to rear surface 6 adjacent end 5 such that when ends 4 and 5 of strap 2 overlap, locking catches 8 and catch receivers 9 matingly engage. Locking catches 8 and catch receivers 9 may take a variety of configurations, but in the preferred embodiment, locking catches 8 and catch receivers 9 are hook and loop fasteners as shown specifically in FIG. 1A, of the type sold under the trademark VELCRO. Alternatively, locking catches 8 may be a plurality of ratchet teeth 10 (FIG. 6A) oriented in a first direction and catch receivers 9 may be plurality of ratchet teeth 11 oriented in a second direction opposite the first direction such that ratchet teeth 10 and 11 are complimentary related and latchingly engage each other. Still further, locking catches 8 may be a plurality of nubs, with catch receivers 9 being a plurality of detents. Interlocking locking catches 8 and catch receivers 9 may take a variety of configurations as long as they extend along a portion of the length of strap 2 and preferably substantially the entire width of strap 2 such that forces acting on belt 1 are evenly distributed over a large surface or latching area 13.

Buckle 3 includes a back piece or body 15 and a front piece or door 16 (FIG. 1). Body 15 includes a base 17 and a top 18. A rear plate 19 extends between base 17 and top 18 and is substantially perpendicular thereto. A pair of parallel retaining bars or posts 20 extend between base 17 and top 18, and are substantially parallel to and spaced apart from rear plate 19. Posts 20 and rear plate 19 define a passage 21 therebetween.

Figure 2:
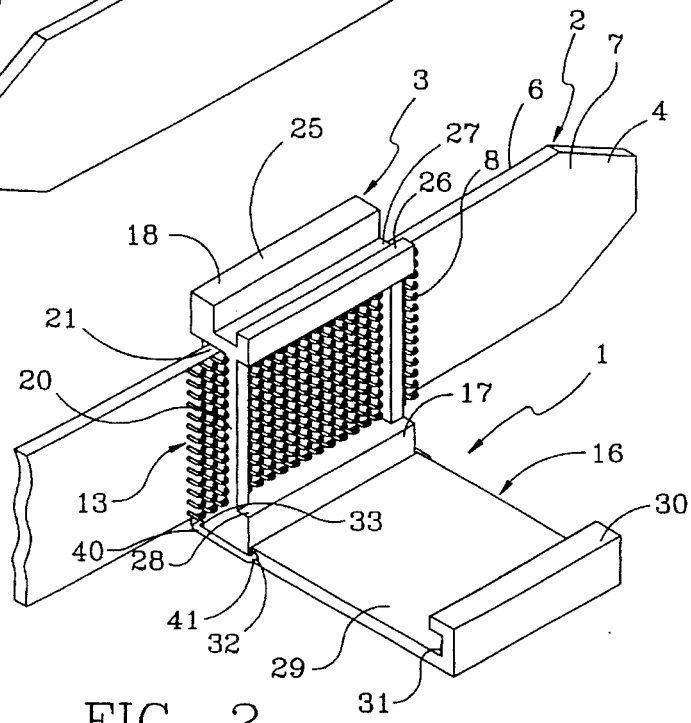
FIG. 2 is a perspective view of the buckle as shown in FIG. 1, with one of the strap ends of FIG. 1A inserted therein.

As best shown in FIG. 2, passage 21 is sized to receive end 4 of strap 2 such that buckle 3 may be positioned adjacent locking catches 8. Inasmuch as the width of passage 21 nearly equals the thickness of strap 2, posts 20 deflect locking catches 8 along the length thereof, and remaining locking catches 8 extend outwardly from strap 2 intermediate posts 20 and on either side thereof to retain buckle 3 on strap 2. Moreover, as passage 21 is only slightly larger than the width of strap 2, each post 20 is offset from rear plate 19 such that strap 2 may be threaded therebetween at an angle to ease the installation of buckle 3 onto strap 2. Once threaded onto the belt and enclosed, the buckle door straightens the strapping by forcing it against the rear plate to hold the strap captive in the passage 21 by the force of bar posts 20 and the adjacent edge of rear plate 19.

Top 18 includes a thumb support 25, a front lip or catch 26 and a recess 27 extending therebetween (FIGS. 1 and 2). Front lip 26 cantilevers outwardly over posts 20 such that a strap opening 28 is defined by base 17, posts 20 and front lip 26. FIG. 1B shows that a space is created between door 16 and base 17 so that the width of the closed strap is slightly larger than the space between the door and rear plate. This uses the natural spring tension of the strap and hook and loop fasteners to work to keep the door tight against latching catch 26 when closed and provide a spring action which forces the door open when latching catch 26 is released.

Door 16 includes a flat panel 29 having a height equal to that of body 15, and a top end with a flange 30 extending therefrom parallel to panel 29. Flat panel 29 and flange 30 define a locking recess 31 therebetween which is complementary shaped to front lip 26. Door 16 also includes a pair of parallel and spaced apart side surfaces, each of which is formed with a hole 32 at the bottom ends thereof.

Base 17 is formed with a pair of holes 33 adjacent holes 32. A pair of double hinge pins 40, each having a pair of legs 41, pivotally attach door 16 to body 15. One leg 41 of each double hinge pin 40 extends into a hole 32 while another leg 41 of each double hinge pin 40 extends into a hole 33 such that each double hinge pin 40 may pivot in both holes 32 and 33 and thus provide translational movement of door 16 relative to body 15.

In operation, strap 2 is wrapped around an object to be retained in position with ends 4 and 5 overlapped such that locking catches 8 and catch receivers 9 operatively engage when pressure is applied thereto. Inasmuch as fasteners of this type, and specifically hook and loop fasteners, are extremely strong when lateral force, or force along the longitudinal direction of the strap, is applied thereto, the only force that will tend to overcome the hook and loop fastener is a force applied perpendicular to surfaces 6 and 7 of strap 2. As such, buckle 3 assures that constant force is maintained against both locking catches 8 and catch receivers 9 in latching area 13 in a direction perpendicular to surfaces 6 and 7.

Figure 4:
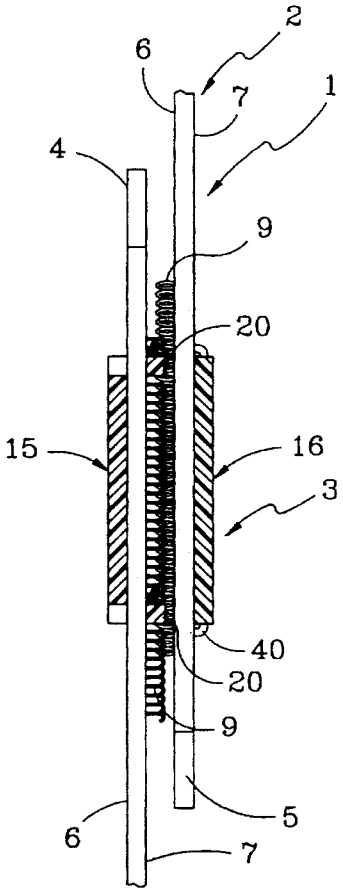
FIG. 4 is a sectional view taken along line 4—4, FIG. 3.
Figure 5:
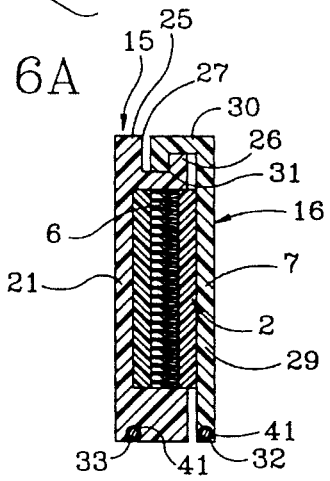
FIG. 5 is a sectional view taken along line 5—5, FIG. 3.
Figure 9:
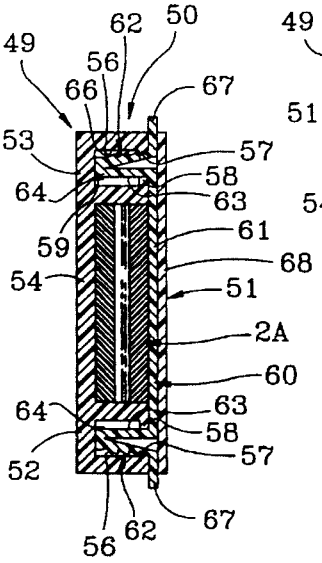
FIG. 9 is a sectional view taken along line 9—9, FIG. 7.
Figure 8:
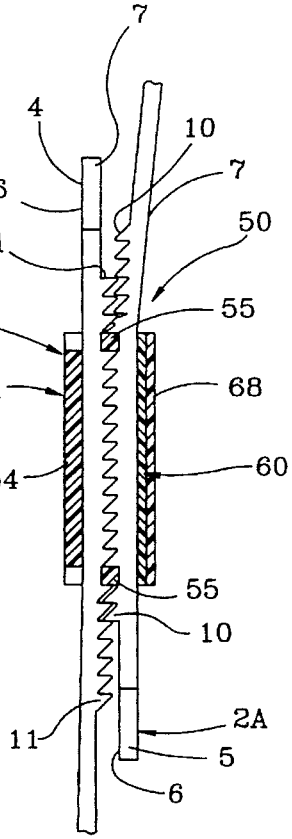
FIG. 8 is a sectional view taken along line 8—8, FIG. 7.

As discussed above, inasmuch as passage 21 is nearly equal to the width of strap 2, strap 2 is fed into passage 21 at an angle relative to posts 20 and rear plate 19. The size of passage 21 also assures that posts 20 slightly deflect locking catches 8 along the length of each post 20 with the remaining locking catches 8 extending outwardly from strap 2 intermediate posts 20, and on either side thereof. The frictional engagement between locking catches 8 and posts 20 is sufficient to retain buckle 3 on strap 2 in the selected position. End 5 of strap 2 is then placed into strap opening 28 and adjacent posts 20 as best seen in FIG. 3, in a motion generally perpendicular to end 4 to matingly engage catches 8 and receivers 9. Door 16 is then moved to the closed position shown in FIG. 3 via the pivoting movement of double hinge pins 40 until flange 30 interlocks with front lip 26 such that flange 30 extends into recess 27 and front lip 26 extends into locking recess 31 (FIGS. 4 and 5). In this manner, constant force on strap 2, perpendicular to surfaces 6 and 7, retains ends 4 and 5 in mating engagement since the width of passage 21 is slightly smaller than the mating ends width. This also causes a positive spring tension on the door which further maintains the door closed tending to keep flange 30 in locking recess 31. Inasmuch as locking catches 8 and catch receivers 9 are extremely resistant to forces acting along the longitudinal direction of strap 2, and buckle 3 applies holding force to strap 2 perpendicular to surfaces 6 and 7, belt 1 is extremely secure.

When belt 1 is to be removed, the user places a thumb on thumb support 25 and squeezes up on the bottom of door 16. Inasmuch as double or dual hinge pins 40 provide translational movement of door 16 relative to body 15, flange 30 and front lip 26 will disengage and door 16 will rotate outwardly away from body 15. In this position, relatively little force is required to disengage locking catches 8 from catch receivers 9. This enables door 16 to move to an open position as shown in FIG. 2 where it is out of the way. In this position, the hook and loop fasteners can be easily separated by lifting the belt when the belt is adjusted or removed.

Figure 6:
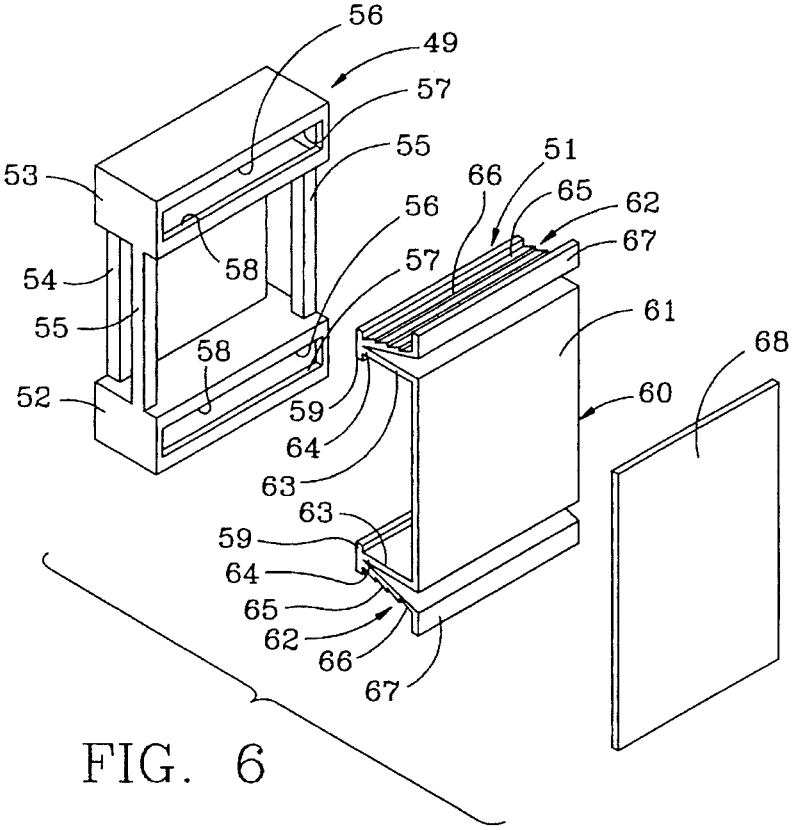
FIG. 6 is an exploded perspective view of a second embodiment of the buckle of the present invention.
Figure 7:
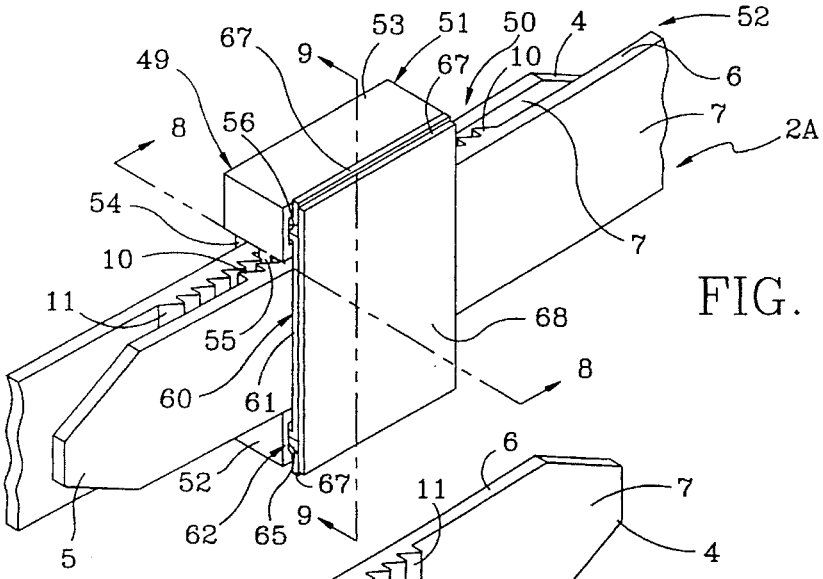
FIG. 7 is a perspective view of the buckle of FIG. 6 in the closed position and shown installed on the ends of the strap of FIG. 6A.

A second embodiment of the present invention is indicated generally at 50, and is shown particularly in FIGS. 6, 7, 8 and 9. Belt 50 includes a strap 2A (FIG. 6A) similar to strap 2 described in detail with respect to the first embodiment of the invention, and a buckle 51 (FIG. 6). Buckle 51 includes a body 49 formed with a base 52, a top 53 and a rear plate 54 which extends between base 52 and top 53 and is substantially perpendicular thereto. A pair of retaining rods or posts 55 also extend between base 52 and top 53 spaced a distance from rear plate 54. Both base 52 and top 53 are substantially rectangular, and are formed with a rectangular recess 56. A flange 57 extends along an outer edge portion of the entrance to each recess 56 and toward strap 2A while a safety flange 58 extends along an inner edge portion of the entrance to each recess 56, and faces away from strap 2A.

Buckle 51 further includes a front piece or closure door 60 formed with a flat panel 61 and a pair of upper and lower spaced projections 62. Projections indicated generally at 62 extend outwardly from each end of flat panel 61 and are sized to be received within recesses 56. Each projection 62 includes a sidewall 63 substantially perpendicular to flat panel 61 which terminates at a free end 64. A biasing member 65 is formed integrally with each sidewall 63 at free end 64 and is angled away from sidewall 63 such that a triangularly shaped slot is formed between each sidewall 63 and a respective biasing member 65. The outer surface of each biasing member 65 is formed with a plurality of ratchet teeth 66, and terminates at an upstanding thumb support 67.

When pressure is applied on thumb supports 67 toward sidewalls 63, biasing members 65 will flex toward the corresponding sidewalls 63. Each free end 64 of each sidewall 63 also includes a flange 59 extending inwardly therefrom, and substantially toward the other sidewall 63. A cover plate 68 is attached to flat panel 61 to add strength and a decorative appearance to door 60 and prevents inadvertent actuation of biasing members 65. In accordance with one of the main features of the present invention, ratchet teeth 66 frictionally engage a respective flange 57 of body 49 when projections 62 are received within recess 56 as described more fully below.

In operation, strap 2A is inserted into buckle 51 substantially the same way as strap 2 is inserted into buckle 3 of the first embodiment of the invention. However, once ends 4 and 5 of strap 2A are overlapped, and locking catches 8 are in mating juxtaposition with catch receivers 9, door 60 is installed within recesses 56. Specifically, each biasing member 65 of projection 62 is compressed inwardly and then inserted within a respective recess 56. Upon release of the compressive force on members 65 they move outwardly and flanges 57 engage a ratchet tooth 66 on biasing members 65 securely retaining door 60 within recesses 56 of buckle 51. Inasmuch as biasing members 65 provide a constant outward force, they will continually apply pressure against flanges 57 and retain door 60 in a position against belt end 5. In the unlikely event that thumb supports 67 are inadvertently actuated such that ratchet teeth 66 are moved out of engagement with flange 57, flanges 59 will engage safety flanges 58 which are formed along the inner edges of each recess 56, before door 60 inadvertently separates from body 49.

Each successive ratchet tooth 66 on biasing members 65 engages a respective flange 57 such that straps of varying thicknesses may be used with a common buckle 51. Specifically, if a belt having a large thickness is utilized, then fewer ratchet teeth 66 pass beyond flanges 57 and into recesses 56 thereby creating a larger space between door 60 and posts 55 for receiving strap 2A. Conversely, if a strap 2A of relatively thin cross-section is utilized, the user simply pushes projections 62 further into recesses 56 such that successive ratchet teeth 66 pass beyond flanges 57 and into recesses 56 thereby creating a smaller space between door 60 and posts 55. As such, buckle 51 may be used on belts of various thickness.

When belt 50 is removed, the user simply applies pressure to both thumb supports 67 overcoming the force of biasing member 65 and disengaging ratchet teeth 66 from flanges 57. Door 60 may then be simply removed from body 49 and locking catches 8 disengage from catch receivers 9 of strap 2A.

As should also be apparent from a review of the figures, belt 1 may be finished on both rear surface 6 and front surface 7 such that belt straps 2 and 2A are reversible. In this manner, both buckles 3 and 51 may be removed from straps 2 and 2A and reinserted thereon in an opposite orientation such that the belt operates substantially as described above, with an opposite surface of straps 2 and 2A facing outwardly. Such an arrangement is particularly useful when belt 1 or 50 is utilized for supporting a pair of trousers on a user, and wherein rear surface 6 is finished with a first color, and front surface 7 is finished with a second color such that the appropriate color may be chosen depending on the trousers worn by the user.

In summary, the invention of the present invention provides a belt 1 having an elongated strap 2 or 2A with interlocking locking catches 8 and catch receivers 9 of the type which are extremely strong when force is applied thereto along the longitudinal direction of strap 2, but offers relatively little resistance to forces acting perpendicular to surfaces 6 and 7. Such interlocking locking catches 8 and catch receivers 9 may be, for example, hook and loop type fasteners 8 and 9, or complementary ratchet teeth 10 and 11. In order to assure that forces acting perpendicular to surfaces 6 and 7 do not inadvertently cause locking catches 8 to disengage from catch receivers 9, a buckle is carried by one end of the belt and is retained thereon via the extension of the locking catches on either side of a pair of posts. A door is then closed on the buckle to apply constant force to strap 2 directly over interlocking locking catches 8 and catch receivers 9. The above described design thus permits forces acting on strap 2 of belt 1 or 50, to be distributed over a large surface area, substantially reducing wear on strap 2, and permitting strap 2 to be manufactured of a less expensive material. In a similar manner, the buckle increases a holding efficiency of the fastening system. In this way, less fastener material is required which reduces the cost of both materials and labor. Also, less fastener material means that the belt will be less cumbersome to use. As an example, strapping made of a large piece of fastener material would be difficult to thread through loops in clothing, and would be cumbersome to fasten and unfasten.

Figure 6A:
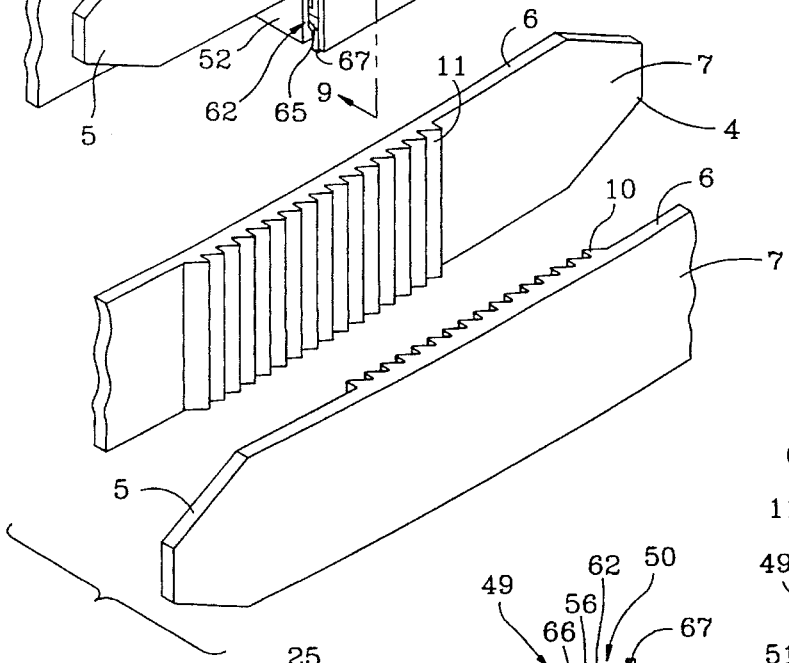
FIG. 6A is a perspective view of a modified pair of strap ends.

The operation of buckle 3 when used with the hook and loop fasteners is different from the operation of buckle 51. Door 16 of buckle 3 swings out of the way when opened so that the hook and loop fasteners can be separated. In contrast, buckle 51 has a closure door that is retained by body 49 and is not removed during normal use. In operation, the closure door acts as a pushbutton to close the innerlocking fasteners together. On removal, closure door 60 is opened only enough to allow the strap to be removed by sliding it out. The buckle design is different depending upon the type fastener used. For hook and loop fasteners, the buckle door must be opened and out of the way to allow the hook and loop fasteners to be separated by a peeling action. The innerlocking fasteners such as shown in FIG. 6A can be readily separated and removed without the need to remove the closure door from the body.

An important feature of the present invention is that the buckle is installable and removable from the strapping yet once installed it will remain in place and retain its setting under normal use and will not fall off or slide off. This action is obtained by offsetting side posts 20 and 55 from rear plate 19 and 54 by am amount equal to the strap width. In this manner, the buckle can only be installed by threading the strap through the passage at an angle. Once installed and the strapping straightened, the force is exerted by posts 20 and 55 and rear plate 19 and 54 act to pinch the strapping and hold it captive in the buckle passage. In this way, the buckle will resist movement. Furthermore, the buckle can be removed or adjusted by relieving the captive forces by rethreading the strapping at an angle.

Accordingly, the improved belt is simplified, provides an effective, safe, inexpensive, and efficient device which achieves all of the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved belt is constructed and used, the characteristics of the construction, and the advantageous, new and useful results obtained; the new and useful structures, devices, elements, arrangements, parts and combinations, are set forth in the appended claims.

I claim:

1. A belt comprising:

an elongated strap having first and second ends and front and rear surfaces;

a locking catch attached to the front surface of the strap adjacent the first end of said strap;

a catch receiver for engaging the locking catch attached to the rear surface of the strap adjacent the second end of said strap such that the ends of the strap are adapted to overlap, with said locking catch in mating engagement with said catch receiver in a latching area;

a buckle having a body and a door movably mounted on said body for movement between open and closed positions, said body having a base, a top and a rear plate, and a pair of posts extending between said base and top and spaced from said rear plate and defining a passage between said rear plate and said posts sized to accept the first end of the strap and locking catch therein for retaining the body of the buckle on said first end of the strap; said posts and door defining a slot therebetween when the door is in the closed position for receiving the second end of the strap and catch receiver therein for mating engagement with the locking catch in the latching area between said posts.

2. A belt as defined in claim 1 in which the strap has a width and a height; in which the distance between the base and top substantially equals the strap height; in which the distance between the rear plate and the pair of posts equals the width of the strap; and in which one of the locking catch and catch receiver extends outwardly from the strap and intermediate the pair of posts.

3. A belt as defined in claim 1 in which one of the locking catch and catch receiver extends outwardly from the strap on both sides of the pair of posts.

4. A belt as defined in claim 1 in which the door is pivotally attached to the base; and in which the body includes a top which forms a releasable door catch for holding the door in the closed position.

5. A belt as defined in claim 4 in which the top of the body includes a lip; and in which the door includes a recess for receiving the lip when the door is in the closed position.

6. A belt as defined in claim 4 in which the door includes a pair of edges; in which a hole is formed in each edge of the door; in which a hole is formed in the body adjacent each edge of the door; and in which dual hinge pins extend into one hole in the door and one hole in the body for pivotally mounting the door on the body.

7. A belt as defined in claim 1 in which a recess is formed in each of the base and top of the body; in which a lip extends along a portion of each of said recesses; and in which the door is removably mounted in said recesses.

8. A belt as defined in claim 1 in which the door includes a pair of spaced projections sized to fit in the recesses; and in which each projection includes a biasing member for engaging a respective lip of the recesses.

9. A belt as defined in claim 8 in which each biasing member includes a plurality of ratchet teeth for engaging a respective lip; in which the ratchet teeth are movable between lip engaging and non-lip engaging positions; and in which each biasing member includes a thumb support whereby pressure applied to said thumb supports will move the ratchet teeth out of engagement with the lips.

10. A belt as defined in claim 1 in which the locking catch is a pad permanently secured to the strap and having a hooked surface; in which the catch receiver is a pad permanently secured to the strap and having a looped surface; and in which the first and second pad are secured to each other by placing the pads in mating engagement, with the hooked and looped surfaces in contact.

11. A belt as defined in claim 1 in which the locking catch is a first plurality of ratchet teeth oriented in a first direction; in which the catch receiver is a second plurality of ratchet teeth oriented in a second direction opposite the first direction whereby the locking catch and catch receiver may be secured to one another by placing the respective ratchet teeth in engagement.

12. A belt as defined in claim 1 further comprising safety means for preventing the door from opening should the locking catches and catch receivers inadvertently disengage.

13. The belt defined in claim 1 including pivot means for pivotally mounting the door on the body.

14. The belt as defined in claim 13 in which the pivot means is a double articulated hinge including a pair of hinge pins, each pin being pivotally attached to and extending between the base and door.

15. The belt defined in claim 1 including a pair of spaced biased members formed on the door; in which a pair of spaced opening is formed in the body; and in which the biased members are received within the body openings for releasably securing the door to the body.

16. The belt as defined in claim 1 in which the locking catch of the strap has a predetermined thickness; and in which the posts are spaced from the rear plate a distance substantially equal to the thickness of the latching catch.

17. The belt as defined in claim 1 in which the base has spaced sides; and in which the posts are spaced outwardly from said base sides.

18. The belt as defined in claim 1 in which a pair of spaced recesses are formed in the top and base of the body; and in which the door includes a pair of spaced flexible projections slidably received in the recesses for securing the door in the closed position.

* * * * *